US007375060B2

(12) United States Patent
Kuzmin et al.

(10) Patent No.: US 7,375,060 B2
(45) Date of Patent: May 20, 2008

(54) PLATING CONCENTRATE

(75) Inventors: Vasily Nikolaevich Kuzmin, Saint-Petersburg (RU); Leongard Ivanovich Pogodaev, Saint-Petersburg (RU)

(73) Assignee: VMPAUTO, Saint Petersburg (RU)

( * ) Notice: Subject to any disclaimer, the term of this patent is extended or adjusted under 35 U.S.C. 154(b) by 431 days.

(21) Appl. No.: 11/038,774

(22) Filed: Jan. 21, 2005

(65) Prior Publication Data

US 2005/0181956 A1 Aug. 18, 2005

(30) Foreign Application Priority Data

Jan. 23, 2004 (RU) ..... 2004102069

(51) Int. Cl.
*C10M 125/04* (2006.01)
*C10M 169/00* (2006.01)
*C10M 137/10* (2006.01)

(52) U.S. Cl. ..... 508/136; 508/172; 508/371; 508/150

(58) Field of Classification Search ..... 508/136, 508/150, 172, 371
See application file for complete search history.

(56) References Cited

U.S. PATENT DOCUMENTS 6,284,322 B1 * 9/2001 Nazaryan et al. ..... 427/386
6,569,816 B2 * 5/2003 Oohira et al. ..... 508/107
2003/0164205 A1 * 9/2003 Prince et al. ..... 148/29

FOREIGN PATENT DOCUMENTS

RU 2124556 C1 1/1999
RU 2185422 C1 * 7/2002
RU 2202600 C2 * 4/2003
SU 1011676 A * 4/1983

OTHER PUBLICATIONS

Grodzinski, P., Brit J. Appl. Phys., 1950, 2(S1), p. 86-90.*

* cited by examiner

*Primary Examiner*—Glenn Caldarola
*Assistant Examiner*—James Goloboy
(74) *Attorney, Agent, or Firm*—Banner & Witcoff, Ltd.

(57) ABSTRACT

The object of the present invention is to provide a protective metal-ceramic film having a heterogeneous structure and possessing higher density, wear resistance, a high adhesion to a friction surface and a friction coefficient after running in not higher than 0.03-0.07.

The above object is solved by providing a plating concentrate comprising a powdered metallic filler, surfactants, oil soluble dialkyl dithiophosphoric acid metal salts and a basic oil, a mineral filler based on silicates and cyclohexanol at the following ratio of components in % by weight:

| | |
|---|---|
| a powdered metallic filler | 0.05-20.0 |
| surfactants | 0.5-11.0 |
| dialkyl dithiophosphoric acid metal salts | 1.0-45.0 |
| a mineral filler based on silicates | 1.2-20.0 |
| cyclohexanol | 0.05-2.0 |

A mineral filler based on silicates comprises natural minerals from a series of layered hydro silicates such as serpentinite and/or chlorite.

Salts of zinc and/or tin and/or molybdenum and/or aluminum and/or copper and/or cadmium are used as dialkyl dithiophosphoric acid metal salts.

2 Claims, 2 Drawing Sheets

1 - addition of the concentrate according to RU 2,202,600

2 - addition of the claimed concentrate

1 - addition of the concentrate according to RU 2,202,600

2 - addition of the claimed concentrate

1 - addition of the concentrate according to RU 2,202,600

2 - addition of the claimed concentrate

PLATING CONCENTRATE

TECHNICAL FIELD

The invention relates to lubricating materials, in particular to concentrates added into motor, transmission and industrial oils and into lubricant greases in order to decrease and eliminate wear of friction surfaces of parts, especially friction pairs of automobile engines, gearboxes etc.

PRIOR ART

From RU 2,124,556, (IPC C10M 163/00, published on Jan. 10, 1999) it is known a metal plating concentrate which is a composition comprising in % by weight: a copper based alloy powder (with particle size from 0.01 to 10 μm)—from 2.0 to 80.0; surfactants—a fatty $C_{12}$-$C_{22}$ mono-carbonic acid and/or a salt thereof with copper (copper stearate) or with zinc (zinc stearate)—from 0.01 to 5.0; an organic solvent—from 5.0 to 40.0 and an organic oil—the rest up to 100.

A large range of changing the fractional composition of particles of metals and alloys added into lubricant composition, is one of the main reasons of friction processes instability as well as of sedimentation instability of a composition resulting in a stratification thereof with a formation of metal particles sediment. A rather long time period is required for forming a "rub" film and realizing protective and restoring properties of a metal plating concentrate. After forming a "rub" film on a friction surface, wear velocity of parts decreases and tribotechnical characteristics get stabilized. However, a formed thin film comprising copper is rather quickly worn after oil discharging. A concentrate needs to be periodically added to restore the film, the friction coefficient being remained significant $f_f$=0.1–0.35.

The closest prior art is RU 2,202,600, (IPC C10M 137/10, published on Apr. 20, 2003), which discloses a lubricating composition comprising in % by weight: a powdered metallic filler (stannous bronze)—from 3 to 30, a surfactant (succinimide additive C-5A)—from 1 to 10, dialkyl dithiophosphoric acid metal salts—from 7 to 30, a basic oil—the rest. During a decomposition of dialkyl dithiophosphoric acid metal salts (Fe, Co, Ni, Al, Mo, Cu, Zn, Sn, Pb), the metals of the above-defined series are precipitated on the friction surfaces; the obtained thin film is of a low density and has low anti-friction properties (a friction coefficient is rather high) as compared to the other ones. A molybdenum salt markedly lowers a friction coefficient but it is rapidly oxidized and losses its anti-friction properties. Phosphides and sulfides, participating in production of a film, insignificantly compensate losses of energy for friction. The used succinimide additive C-5A is a dispersant for maintaining the particles, contaminating oil, in a suspended state. However, unlike a fatty acid, a succinimide additive as a surfactant, weakly interacts with metallic particles of a filler and does not exert a desired effect. Metallic particles oxidize oil of a lubricating composition (process oil) and they are prone to aggregation that deteriorates a lubricant quality and shortens the oil service term.

DISCLOSURE OF THE INVENTION

The object of the present invention is to decrease and eliminate wear of friction surfaces of parts, predominantly friction pairs of automobile engines, gearboxes etc.

The above object is achieved by providing a plating concentrate, the addition of which results in a formation of a protective metal-ceramic film on friction surfaces, the above film has a heterogeneous structure and higher density, wear resistance, a high adhesion to a friction surface and a friction coefficient after running in is not higher than 0.03-0.07.

The concentrate according to the present invention comprises a powdered metal filler, surfactants, oil soluble dialkyl dithiophosphoric acid metal salts and a basic oil, in which the improvement consists in that the concentrate comprises a mineral filler based on silicates and cyclohexanol at the following ratio of components in % by weight:

a powdered metallic filler 0.05-20,
surfactants 0.5-11
dialkyl dithiophosphoric acid metal salts 1-45
a mineral filler based on silicates 1.2-20
cyclohexanol 0.05-2.0

A mineral filler based on silicates comprises natural minerals from a series of layered hydra silicates such as serpentinite and/or chlorite.

A mineral filler can additionally comprise fiberglass and powdered quartz at the following ratio of the components in the mentioned filler in % by weight:

fiberglass 15-42
powdered quartz 30-42
natural minerals from the series of layered hydro silicates the rest up to 100.

Salts of zinc or tin or molybdenum or aluminum or copper or cadmium or mixtures thereof are preferably used as dialkyl dithiophosphoric acid metal salts (DADTPA).

Surfactants may include $C_{12}$ mono-carbonic fatty acid and additionally imide derivatives of succinic acid at the following ratio of components in a total composition of surfactants in % by weight:

$C_{12}$ mono-carbonic fatty acid—5.0-33.0
imide derivatives of succinic acid—the rest up to 100.

Alloys based on nonferrous metals preferably selected from the series: copper-tin-silver, copper-tin, zinc-cadmium, aluminum-tin-copper are reasonably used as a powdered metallic filler.

BRIEF DESCRIPTION OF FIGURES

Essence of the invention is disclosed in more details in the Examples of realization of the invention given below, which serve for illustration only and do not limit the scope of the invention.

Properties of the concentrate are illustrated by graphs, which present data as follows.

EMBODIMENTS OF THE INVENTION

Figure 1:
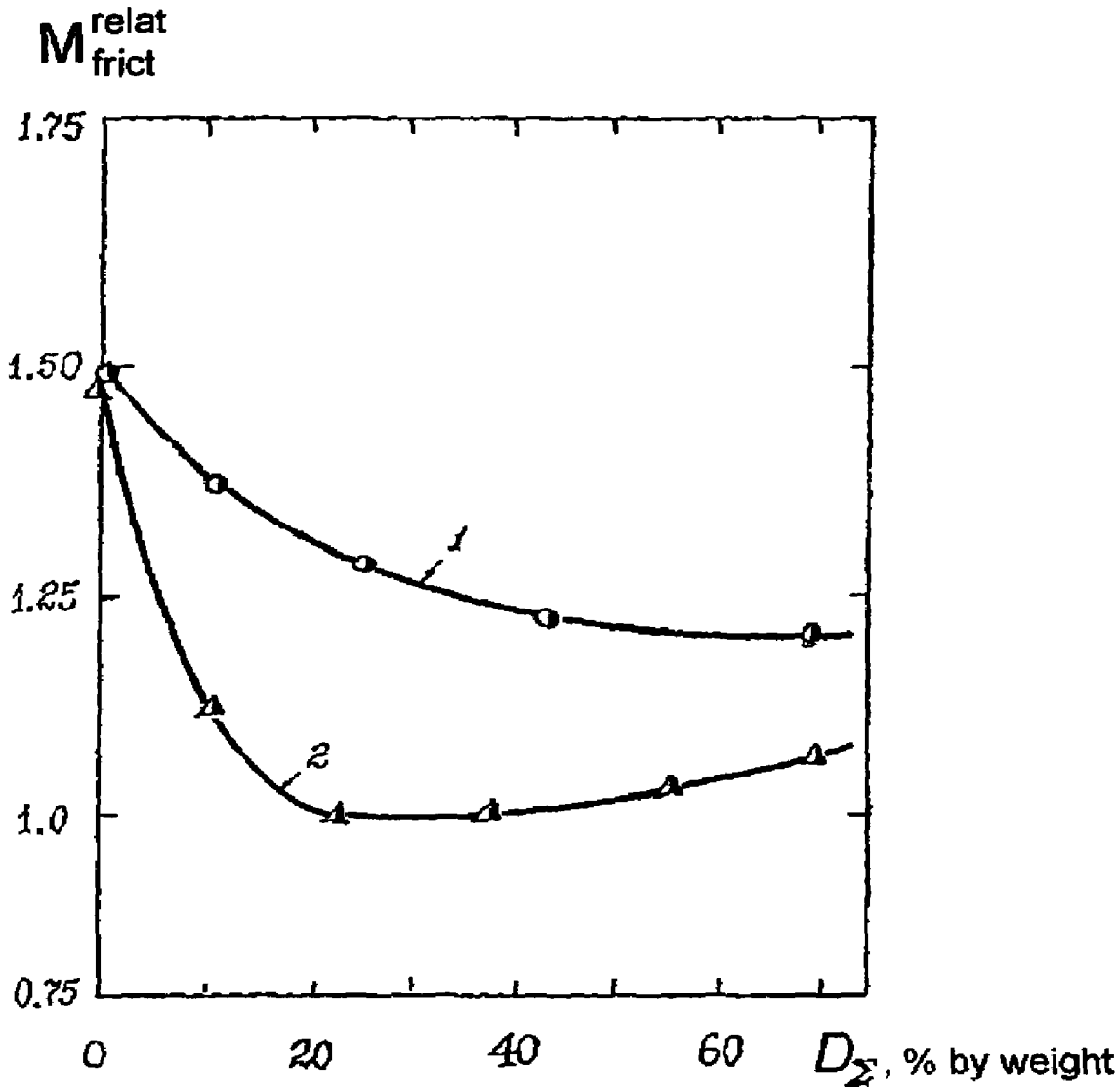
FIG. 1 demonstrates a relationship between relative friction momentum and a concentrate amount in the lubricating composition.

The concentrate examples (possible quantitative variations) are presented in Table 1. In the context of the present application cadmium dimethyl can be regarded as an equivalent of an oil soluble cadmium salt of dialkyl dithiophosphoric acid (cadmium DADTPA) as these compounds show identical properties in the claimed concentrate.

The comparative tests results of tribojoinings Steel 45-Gray Iron 25 on a friction machine according to the scheme "roller-roller" in using the lubricating composition with the additives according to the claimed concentrate and to the composition of the closest prior art (RU 2,202,600) are presented in Table 2.

The concentrate is prepared in the following way. The necessary powdered components (powders of metallic alloys with the fraction 0.1-5.0 μm for example, stannous bronze, mineral filler, oil soluble dialkyl dithiophosphoric acid metal salts) are mixed with the predetermined ratio, poured over with the basic oil and dispersed in the stirrers; at the same time the additional sonication may be performed. A surfactant and cyclohexanol are introduced by dosing into the obtained composition, the whole components are thoroughly stirred up to obtaining a homogenous mass.

The amount of oil in the finished concentrate is not less than 5-10% of a total mass that provides for required fluidity and mass homogeneity.

The concentrate can preserve its antifriction properties and suspension homogeneity without stratification thereof for a long time (not less than one year).

The prepared concentrate is introduced into lubricating compositions that operate in friction blocks of machines and mechanisms.

When exploiting the lubricating compositions into which the claimed concentrate is introduced, a protective film with heterogenous structure consisting of ceramic and metallic particles is formed on friction pairs, i.e. a metal-ceramic servovite film is formed.

Particles of metallic alloys, in the film, promote a rise of a heat removal from the friction surfaces and promote an enhancement of antifriction properties. In this case, metallic particles appear impacted into the ceramic layer and do not oxidize oil.

The oil soluble DADTPA metal salts in the lubricating composition (LC) promote a lowering of the friction coefficient and serve as suppliers of metallic particles for self-renewal of the film that results in remetallization of its components. An introduction of DADTPA metal salts allows, when needed, minimization of the amount of the metallic filler introduced into a composition. Furthermore, DADTPA metal salts serve as a supplier into a friction zone of phosphides and sulfides that are the substances being solid lubricants and preventing jamming (seizing) of joined surfaces. A powered mineral filler from the series of layered hydro silicates, for example, magnesium hydro silicate (serpentine), chlorite, talc, fayalite etc. following decomposition in the friction zones at the local short-term elevations of temperature amounting several hundreds degrees centigrade, forms a glassy protective layer possessing plasticity and a good running in at high temperatures, a high wear resistance and a low friction coefficient.

Ground fiberglass and quartz powder micro reinforce a metal-ceramic film, enhance strength and density of the film, decrease friability at dynamic loadings and promote acceleration of running in joined surfaces. Further, these components participate in forming the film, that decreases a possible negative effect of abrasive particles, present as hydro silicates (olivines and pyroxenes.)

Use of fatty acids (oleic, stearic and others) as surfactants provides for a plating of metallic particles, which are both in suspended state and introduced into metal-ceramic film, that also prevents an oil oxidation. Imide derivatives of succinic acid are not only surfactants but they also function as a dispersant of contaminating oil particles (of different origin) preventing their coagulation. Presence of cyclohexanol in the composition increases a volume viscosity of the lubricant layer in the gap between the restored (with metal-ceramic layer) surfaces and promotes realizing favorable hydrodynamic friction regimen, i.e. non-wear phenomenon.

Thus a serovite film obtained on the tribojoining surfaces possesses a high strength, density, hardness ($H_\mu \approx 6000$ MPa), a high adhesion and required elasticity that allows to hold out dynamic loadings including vibration loadings. The claimed concentrate used in the lubricating compositions, allows restoring worn parts up to nominal dimensions by filling local damages (fissures, pitting). Friction coefficient after running in and formation of metal-ceramic layer is 0.03-0.06; during further exploitation a gap between parts remains stable.

Table 2 presents the results of comparative tests on a friction machine of tribojoinings Steel 45-Gray Iron 25 according to the scheme "roller-roller" in using the lubricating composition with the additives according to the claimed concentrate and to the composition according to RU 2,202,600. A steel roller was immobile and a 50 nm diameter cast iron roller was rotating at a linear speed 1.3 m per one second. Table 2 presents the values for particular compositions corresponding to the compositions of the graph "B" in Table 1.

Table 2 shows that the relative wear velocity of friction pair $V_{wear}^{relat}$ for the different examples of the claimed concentrate is 1.0-3.0, whereas the wear velocity using the composition according to RU 2,202,600 is significantly higher and varying from 2.4 to 7.4.

Mean value of wear velocity $V_{wear}^{relat}$ for $D_\Sigma \geqq 10$, where $D_\Sigma$ is concentrate percent in the LC for the claimed concentrate is 1.58 versus 3.25 for RU 2,202,600, i.e. it is twice lower.

Table 2 also shows that a relative friction momentum $M^{frict relat}$ for the different examples of the claimed concentrate is 1.0-1.11, while a relative friction momentum for the formulation according to RU 2,202,600 is significantly higher and varying from 1.2 to 1.42.

Mean value $(M_{frict)mean}^{relat}$ of the friction momentum for $D_\Sigma \geqq 10$ for the claimed concentrate is 1.03 versus 1.3 of RU 2,202,600, i.e. it is lower by 30%.

A graph of the function $M_{frict}^{relat}=F(D_\Sigma)$ is presented in FIG. 1. The graph shows that the values of $M_{frict}^{relat}$ for the claimed concentrate are essentially lower at the same values of $D_\Sigma$, while a lowering velocity is significantly higher.

Figure 2:
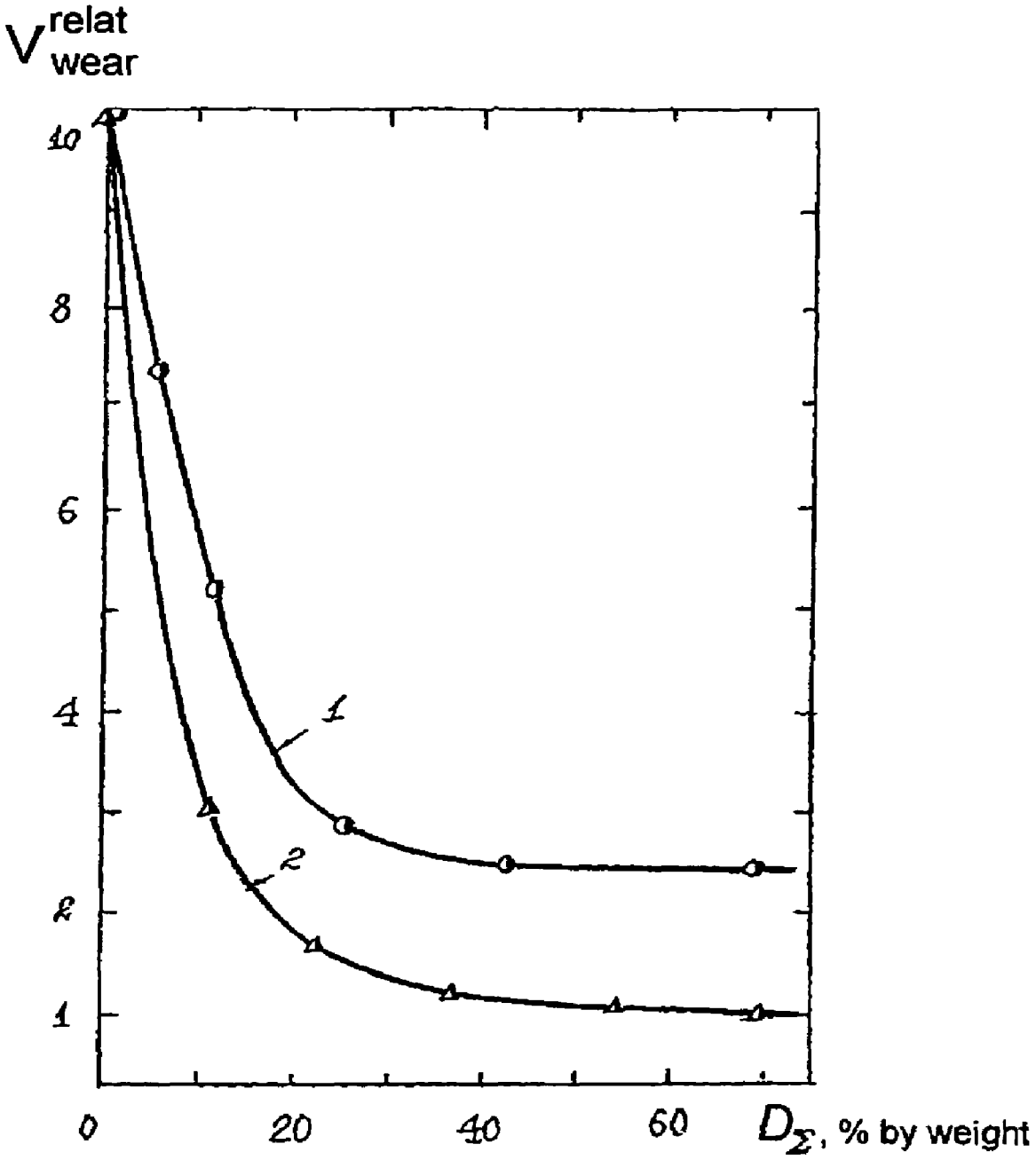
FIG. 2 demonstrates a relationship between relative wear velocity and the concentrate amount in the lubricating composition.

A graph of the function $V_{mean}^{relat}=F(D_\Sigma)$ is presented in FIG. 2. The graph shows that the values of $V_{mean}^{relat}$ for the claimed concentrate is essentially lower, while the lowering velocity is significantly higher.

The both graphs clearly demonstrate the advantages of the claimed concentrate over the closest prior art.

It should be also noted that after an oil discharging and substitution the working capacity of the film is preserved for 500-600 cycles of exploitation without adding the concentrate.

TABLE 1

| Composition (variations) of the plating concentrate | | | | | | | | |
|---|---|---|---|---|---|---|---|---|
| | Compositions according to the invention | | | | | | | |
| Components | A | B | C | D | E | F | Size of powder particles | Notes |
| | Powdered filler | | | | | | | |
| Metallic | | | | | | | | |
| Copper-tin-silver | 1-15 | — | — | — | — | — | 0.1-0.5 | Alloy: Cu-base Sn ≦ 20%; Ag ≦ 0.5 |
| Copper-tin | — | 1-15 | — | — | — | 0.05 | 0.1-5.0 | Alloy: Cu-base Sn ≦ 20% |
| Zinc-cadmium | — | — | ≦15 | — | 0.05 | — | ≦10 for lubricant grease | Alloy: Zn-70%; Cd-30% |
| Aluminum-tin-copper | — | — | — | ≦15 | — | — | 0.1-5.0 | Alloy: Al-82%; Sn-16.5%; Cu-1.5% |
| Mineral | | | | | | | | |
| Serpentinite | 0.1-5.0 | 0.1-5.0 | 0.1-5.0 | 0.1-5.0 | 0.1-5.0 | 0.1-5.0 | | |
| chlorite | 0.1-5.0 | 0.1-5.0 | 0.1-5.0 | 0.1-5.0 | 0.1-5.0 | 0.1-5.0 | 0.5-5.0(10) | |
| Fiberglass | 0.5-2 | 0.5-2 | 0.5-2 | 0.5-2 | 0.5-2 | 0.5-2 | Thickness/length ~0.1/5.0 | — |
| Powdered quartz | 0.5-5 | 0.5-5 | 0.5-5 | 0.5-5 | 0.5-5 | 0.5-5 | 0.1-5.0 | — |
| | Oil soluble metallic dialkyl dithiophosphoric acid metal salts (Zn, Cd, Sn, Mo, Al, Cu salts of DADTPA) | | | | | | | |
| Zinc salt of DADTPA | — | — | — | — | 1-15 | — | | |
| Cadmium and dimethyl cadmium salts of DADTPA | — | — | — | — | 1-15 1-6 | — | | |
| Tin salt of DADTPA | 1-10 | 1-10 | — | 1-10 | — | 1-5 | | |
| Molybdenum salt of DADTPA | 1-18 | 1-18 | 1-28 | 1-18 | 1-12 | 1-12 | | |
| Aluminum salt of DADTPA | — | — | — | — | — | 1-24 | | |
| Copper salt of DADTPA | — | — | — | — | — | 0.5-1 | | |
| | Surfactants | | | | | | | |
| Imide derivatives of succinic acid | 1-10 | 1-10 | 1-10 | 1-10 | 1-10 | 1-10 | | |
| Mono-carbonic $C_{12}$ fatty acid | 0.5 | 0.5 | 0.5 | 0.5 | 0.5 | 0.5 | | |
| | Other components | | | | | | | |
| Cyclohexanol | ≦1.5 | ≦1.5 | ≦1.5 | ≦1.5 | ≦1.5 | ≦1.5 | | |
| Oil | Organic oil up to 100% | | | | | | | |

TABLE 2

| Results of the comparative tests of tribojoinings Stel 45-Gray Iron 25 | | | | | | | |
|---|---|---|---|---|---|---|---|
| | | Formulation variants of lubricant composition corresponding to composition "B" of Table 1 | | | | | The closest prior art RU |
| Order No | Component, % by weight | I | II | III | IV | V | 2,202,600 |
| 1 | Powdered metallic filler | 1 | 3 | 5 | 10 | 15 | 2-30 |

TABLE 2-continued

| Order No | Component, % by weight | Results of the comparative tests of tribojoinings Stel 45-Gray Iron 25 — Formulation variants of lubricant composition corresponding to composition "B" of Table 1: I | II | III | IV | V | The closest prior art RU 2,202,600 |
|---|---|---|---|---|---|---|---|
| 2 | Mineral filler (MF) | 1 | 5 | 10 | 15 | 20 | — |
| 3 | Molybdenum dialkyl di-thiophosphate | 1 | 5 | 10 | 15 | 18 | 1-30 |
| 4 | Tin dialkyl di-thiophosphate | 1 | 2.5 | 5 | 7.5 | 10 | — |
| 5 | Dispersant succinimide C-5A | 5 | 5 | 5 | 5 | 5 | 1-10 |
| 6 | Surfactant - fatty monocarbonic acid | 0.5 | 0.5 | 0.5 | 0.5 | 0.5 | — |
| 7 | Cyclohexanol | 1.5 | 1.5 | 1.5 | 1.5 | 1.5 | — |
| 8 | Oil I-20 | 89* | 77.5* | 63* | 45.5* | 30* | 96-30 |
| | | Testing results of friction pair | | | | | |
| 9 | Relative wear | 3.0 | 1.7 | 1.2 | 1.0 | 1.0 | 2.4-7.4 |
| 10 | velocity of friction pair | | | Mean value at $D_\Sigma \geqq 10$ | | | |
| | $V_{wear}^{relat}$ | | | $V_{mean}^{relat} = 1.58$ | | | $V_{mean}^{relat} = 3.25$ |
| 11 | Relative friction | 1.11 | 1.0 | 1.01 | 1.03 | 1.07 | 1.2-1.4 |
| 12 | momentum $M_{frict}^{relat}$ | | | Mean value at $D_\Sigma \geqq 10$ | | | |
| | | | | $(M_{frict})_{mean}^{relat} = 1.03$ | | | $(M_{frict})_{mean}^{relat} = 1.30$ |

*Industrial oil I-20, including oil comprised in the concentrate itself.

What is claimed is:

1. A plating concentrate comprising a powdered metallic filler, surfactants, oil soluble dialkyl dithiophosphoric acid metal salts and a basic oil, cyclohexanol and mineral filler which comprises: a fiberglass, powdered quartz, natural minerals from the series of layered hydro silicates, at the following concentration of components in % by weight:

| | |
|---|---|
| a powdered metallic filler | 0.05-20.0 |
| surfactants | 0.5-11.0 |
| dialkyl dithiophosphoric acid metal salts | 1.0-45.0 |
| cyclohexanol | 0.05-2.0 |
| mineral filler comprising: fiberglass, powdered quartz and natural minerals from the series of layered hydro silicates, in the aggregate | 1.2-20.0 |

a basic oil—the rest up to 100;

wherein concentrations of the components of the said filler in % by weight are as follows:

| | |
|---|---|
| fiberglass | 15.0-42.0 |
| powdered quartz | 30.0-42.0 |

natural minerals from the series of layered hydro silicates the rest up to 100.

2. The plating concentrate according to claim 1, wherein serpentinite and/or chlorite are used as the layered hydro silicates.

* * * * *